US005461868A

United States Patent [19]

Finko

[11] Patent Number: 5,461,868

[45] Date of Patent: Oct. 31, 1995

[54] METHOD AND DEVICE FOR GAS COOLING

[75] Inventor: Valery E. Finko, Sankt-Peterburg, Russian Federation

[73] Assignee: Aktsionernoe Obshestvo "SIGMA-GAZ", Sankt-Petersburg, Russian Federation

[21] Appl. No.: 211,049

[22] PCT Filed: Jul. 10, 1992

[86] PCT No.: PCT/RU92/00137

§ 371 Date: Mar. 10, 1994

§ 102(e) Date: Mar. 10, 1994

[87] PCT Pub. No.: WO94/01727

PCT Pub. Date: Jan. 20, 1994

[51] Int. Cl.[6] ..... F25B 9/02

[52] U.S. Cl. ..... 62/5

[58] Field of Search ..... 62/5

[56] References Cited

U.S. PATENT DOCUMENTS

| | | | |
|---|---|---|---|
| 1,952,281 | 3/1934 | Ranque . | |
| 3,775,988 | 6/1980 | Fekete . | |
| 4,458,494 | 7/1984 | Fekete . | |

FOREIGN PATENT DOCUMENTS

| | | | |
|---|---|---|---|
| 0858260 | 7/1949 | Germany | 62/5 |
| 744196 | 6/1980 | Russian Federation . | |
| 985639 | 12/1982 | Russian Federation . | |
| 1257374 | 9/1986 | Russian Federation . | |
| 113268 | 9/1989 | Russian Federation . | |
| 0798435 | 1/1981 | U.S.S.R. | 62/5 |
| 1121556 | 1/1984 | U.S.S.R. | 62/5 |
| 1449792 | 1/1989 | U.S.S.R. | 62/5 |

OTHER PUBLICATIONS

"Cooling and Condensation of Gas in a Vortex Flow", V. E. Finko, Physics Technology, Sep. 1983.

"The vortex effect and its engineering uses" by A. P. Merkulov, Moscow Mashinostroenie PH, 1969.

"Effect of cooling in undulatory adiabatic gas expansion" by A. M. Arkharov et al., Proceedings of the USSR Academy of Science, Power and Transport, 1981, No. 2.

*Primary Examiner*—Ronald C. Capossela

*Attorney, Agent, or Firm*—Merchant, Gould, Smith, Edell, Welter & Schmidt

[57] ABSTRACT

A method for gas cooling with the use of a vortex tube into which the gas to be cooled is admitted through a scroll, where the gas is swirled and accelerated, and is expanded at the inlet of the vortex tube, then is divided into a peripheral part and an axial part, the peripheral part of the gas stream being discharged from the cooler along curvilinear pathways which are joined together with the pathway of motion of the gas stream over the tube walls, without formation of standing waves. A gas cooler comprises a scroll (1), an expansion chamber (2), and outlets for the peripheral and axial parts of the gas stream, wherein the peripheral part of the gas stream is discharged either through curvilinear ports (7) made in the wall of the expansion chamber, or through a second scroll (11). The gas which has passed through the second scroll, is joined with the axial part of the gas stream.

6 Claims, 4 Drawing Sheets

METHOD AND DEVICE FOR GAS COOLING

TECHNICAL FIELD

The present invention relates to refrigerating engineering and can be used for gas cooling both per se and for subsequent use of the precooled gas as a refrigerant.

BACKGROUND ART

A variety of methods and devices for producing cooled gases are known at present.

According to one of such methods, volume oscillations are established in a gas stream so that the latter is split into two flows, a reduced pressure and temperature flow used for cold generation, and an elevated pressure and temperature flow used for heat generation (cf., e.g., USSR Author's Certificate No. 113,268, Cl. F 25 B 9/02, published 1989).

Known in the art presently is also use for gas cooling of Hartmann-Siringer acoustic generators, wherein the acoustical resonator gets heated to high temperatures due to formation of standing waves, though in this case the withdrawn gas is somewhat cooled (cf. "Effect of cooling in undulatory adiabatic gas expansion" by A. M. Arkharov et al., Proceedings of the USSR Academy of Sciences, Power and Transport, 1981, No. 2 (in Russian).

Both of the methods mentioned above are disadvantageous because of low efficiency of gas cooling and because of producing heat alongside with cold, which is useless and even harmful as far as refrigerating engineering is concerned.

The disadvantage mentioned above is also inherent in the most extensively used heretofore Ranque-Hilsh gas energy dividers based on the use of the so-called vortex tubes, wherein gas is subjected to swirling and acceleration, followed by its being discharged (exhausted) into the expansion chamber in which gas is divided into a cooled and a preheated stream (cf., e.g., U.S. Pat. No. 1,952,281, 1934, and also "The vortex effect and its engineering uses" by A. P. Merkulov, Moscow Mashinostroenie PH, 1969 (in Russian).

Apart from the disadvantage mentioned above, vortex tubes suffer from a reduced cooling effect in response to a higher gas intake pressure.

The most similar to the present invention as to its technical essence is the vortex cooler, comprising a scroll with a gradually tapered spiral duct, as well as a cold gas exit nozzle and an expansion chamber, each being situated on one side of the scroll, the expansion chamber has a throttle at one of its ends, the throttle appearing as a blank cover so fitted as to leave a gap for hot gas to escape (cf., e.g., U.S. Pat. No. 3,775,988 published 1973).

The device discussed above carries into effect the following gas cooling process. A stream of a cooled gas is pressure-admitted to the scroll through an inlet nozzle. While passing along the gradually tapered spiral duct of the scroll the gas stream gets swirled and accelerated to a supersonic velocity, whereupon it is discharged from the scroll into the expansion chamber which is shaped as a taper or cylindrical tube. While passing along a helical pathway over the chamber walls the gas stream reaches the blank cover, after which part of the stream is reflected from the blank cover and returns backward along the axial tube portion to be discharged through a cold gas exit nozzle (said part of the gas stream being hereinafter referred to as axial part, while the other part of the gas stream (that is, the peripheral one)) is discharged through exit ports provided at the place where the blank cover is held to the expansion chamber.

Throttling of the peripheral gas stream portion at the outlet thereof, according to the known method and device results in the onset of standing waves causing heating of said stream part, with the resultant elevation of the temperature in the axial part of the stream, which affects adversely the effectiveness of the cold generation process.

SUMMARY OF THE INVENTION

It is a principal object of the invention to rule out or at least to reduce the danger of formation of standing waves during discharge of the peripheral stream part and to increase thereby the effectiveness of the gas cooling method and of the refrigerants used for carrying said method into effect.

There are proposed two versions of a method for gas cooling in order to accomplish the foregoing object, involving the use of vortex tubes and accordingly two embodiments of a vortex cooler, based on the same common inventive conception, which resides in and is aimed at reducing deceleration of the peripheral stream part at the exit, said deceleration being characteristic of the known methods and devices. Such a reduction of the gas stream deceleration is ensured due to the fact that the stream peripheral part is discharged along curvilinear pathways joined with the pathway of said stream part in the expansion chamber. According to a second version of the method, the peripheral stream part is forwarded to the gradually tapered spiral duct, wherein the stream is reswirled and reaccelerated, followed by discharging the stream into the expansion chamber. Further development of said version consists in that the peripheral stream part which has passed a repeated cycle of swirling, acceleration, and expansion, is joined together with the axial stream part and both stream parts are discharged from the vortex tube jointly.

Both variants of the method proposed herein are advantageous over the heretofore-known methods in the fact that an acoustical effect produced by the peripheral stream part on the axial part thereof and causative of an undesired heating of the latter stream part, is reduced due to a smooth withdrawal of the stream peripheral part through the curvilinear passages joined with the pathway of said stream part over the walls of the vortex tube, the spiral duct (according to the second variant of the method) inclusive. Said acoustical effect encountered in the known methods is due to superposition of acoustical fields arising during gas admission through the scroll and withdrawal of the peripheral stream part. When the frequency of the incoming gas stream coincides with that of the outgoing gas stream, resonance phenomena occur, resulting in formation of standing waves.

Taking account of the fact that the length of an acoustical wave equals fractions of a millimeter, superposition (coincidence) of an even or odd number of waves in the zones preventing the stream motion, cannot virtually be allowed for in advance when designing the overall dimensions of the cooler construction.

Moreover, repeated swirling, acceleration, and expansion of the peripheral stream part are provided by virtue of its intrinsic energy, which results in a further dropping of its temperature and hence in a higher effectiveness of the gas cooling process.

A peculiar feature of a cooler implementing the method of the present invention and provided as a vortex tube with a scroll featuring a spiral tapered duct extending to the tube, and an expansion chamber provided with a blank cover at one of its ends and an outlet for the peripheral stream part, resides in the fact that said outlet is in fact a number of ports in the side wall of the expansion chamber, said ports being of a curvilinear shape.

Further development of said version of the gas cooler consists in the provision of curved tubes connected to the curvilinear ports in the wall of the expansion chamber, the axial lines of said curved tubes being in fact an extension of the axial lines of the ports, and an integration of the outlet ends of said tubes to form a header.

According to a second embodiment of the cooler of the present invention, a second scroll is provided in the expansion chamber near the blank cover, said scroll facing with its inlet against the motion of the peripheral stream part.

BRIEF DESCRIPTION OF THE DRAWINGS

In what follows the invention is illustrated by some specific exemplary embodiments of gas cooler disclosed herein to be had with reference to the accompanying drawings, wherein.

DETAILED DESCRIPTION OF THE PREFERRED EMBODIMENT

Figure 1:
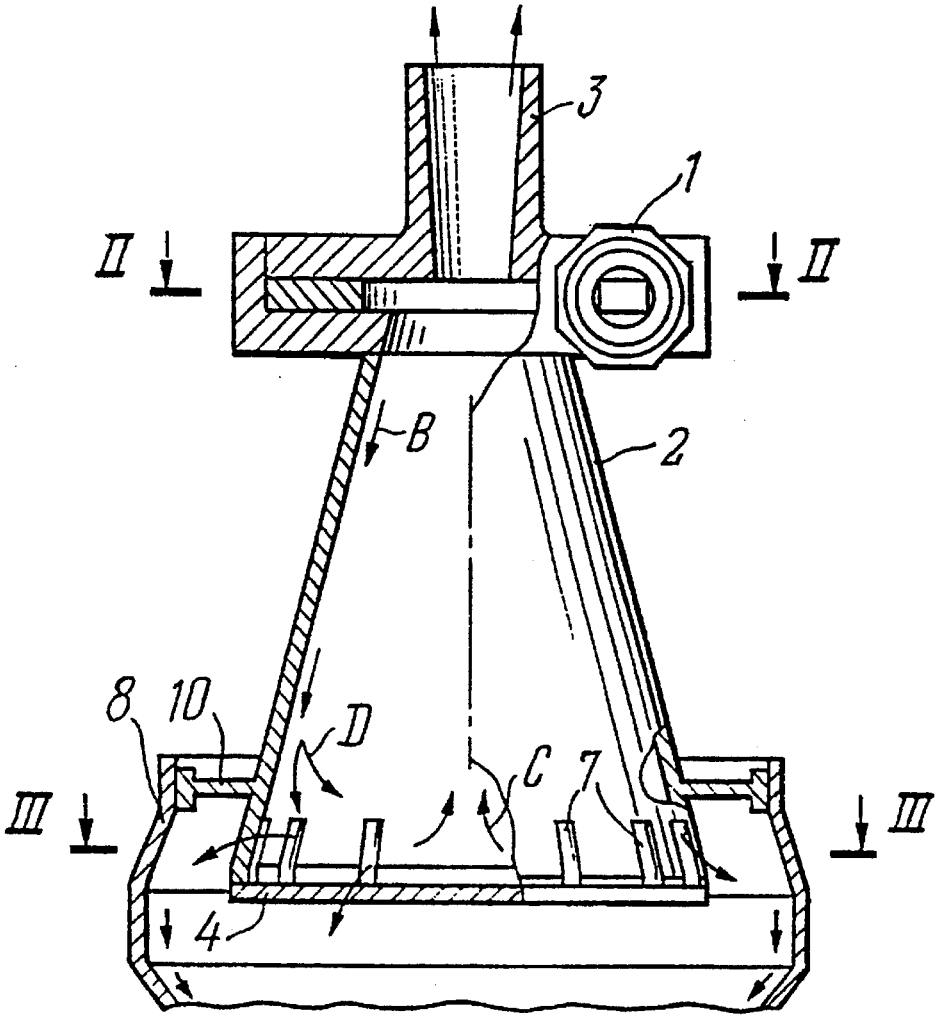
FIG. 1 is a sectional view of an embodiment of the gas cooler showing the outlets for the peripheral stream part through curvilinear ports in the side wall of the expansion chamber.
Figure 2:
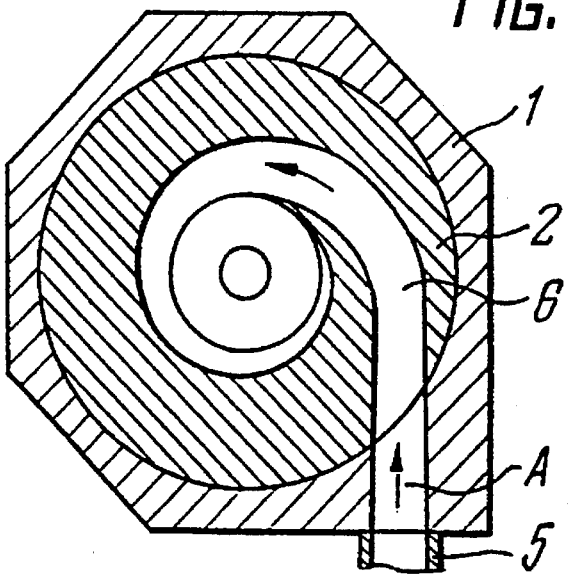
FIG. 2 is a section taken along the line I—I in FIG. 1.
Figure 3:
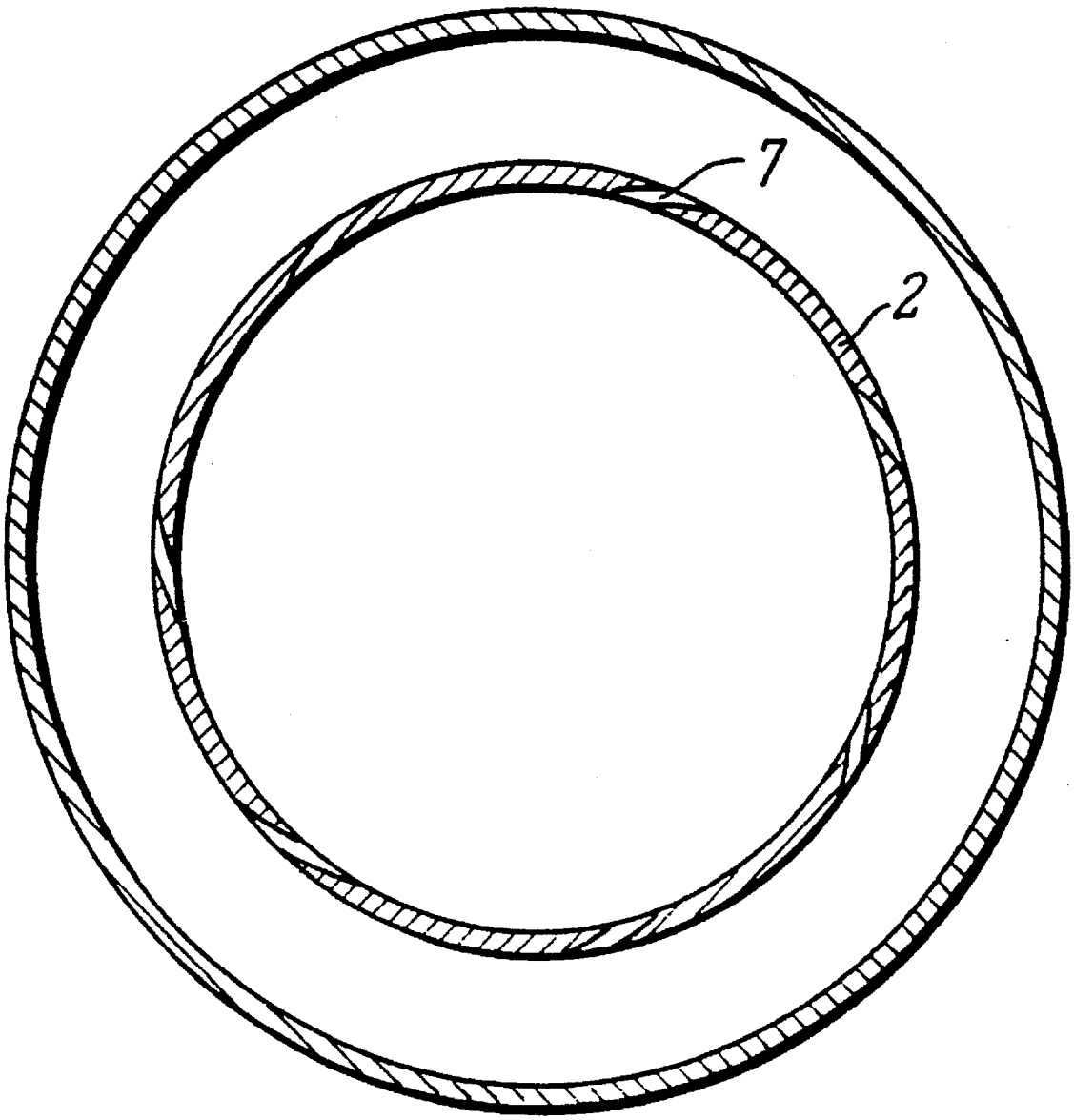
FIG. 3 is a section taken along the line II—II in FIG. 1.
Figure 4:
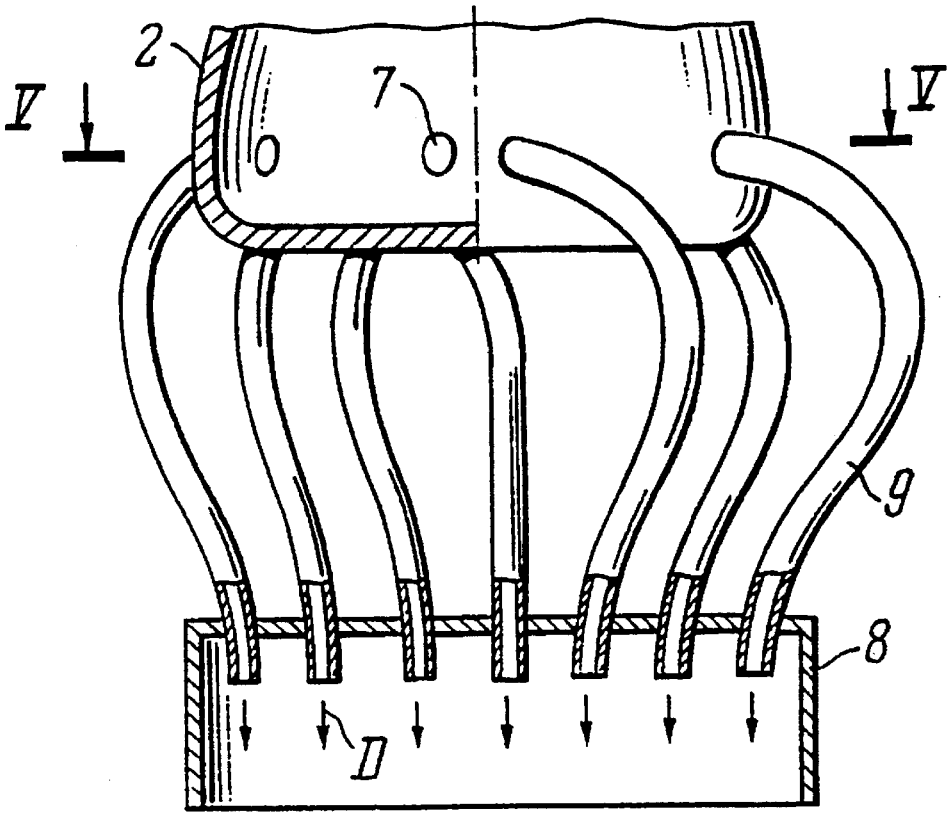
FIG. 4 illustrates the outlets for the peripheral stream part through curved tubes.
Figure 5:
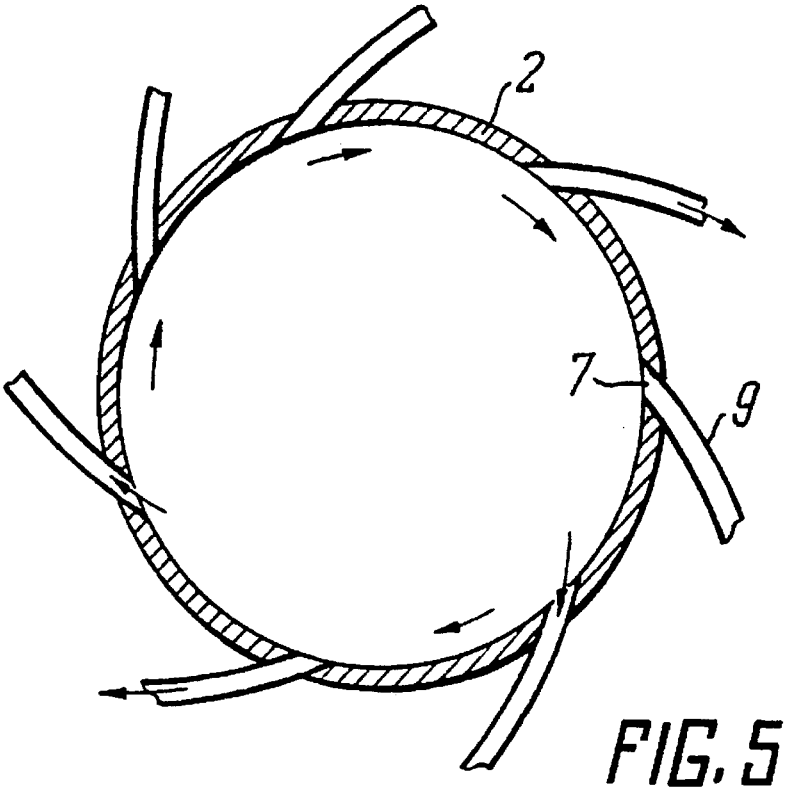
FIG. 5 is a section taken along the line V—V in FIG. 4.

The gas cooler illustrated in the accompanying Drawings and serving for carrying into effect the method for gas cooling, according to the present invention, being itself the subject-matter of the invention, consists of a scroll 1, an expansion chamber 2 located on one side of the scroll 1, and a cooled gas exit nozzle 3 situated on the opposite side of the scroll 1. The expansion chamber 2 is closed at its end distant to the scroll, with a blank cover 4. The scroll 1 has an admission nozzle 5 for the gas to be cooled, said nozzle being arranged tangentially to the scroll axis, and a spiral tapered duct 6 extending to the expansion chamber 2. According to a first embodiment of the device (FIGS. 1–5), the expansion chamber 2 is provided with ports 7 for discharging the peripheral stream part, the ports being located in the end portion of the expansion chamber adjacent to the blank cover 4. The ports 7 are curvilinear and oriented in the direction of motion of the peripheral stream part over the wall of the expansion chamber, and can either open immediately into a header 8 for the peripheral stream part, or communicate with curved tubes 9 whose axial lines are in fact the extension of the axial lines of the ports, which in turn open into the header 8. The latter is fitted on the expansion chamber with a possibility of longitudinal motion with respect to the axis of the chamber, the motion being effected due to, e.g., a threaded joint between the header and a ring 10 made fast on the chamber.

To reduce resistance to the gas stream discharge into the header, the internal wall thereof has a gentle curve, which also prevents the onset of standing waves in this zone and the heating of the header. It is due to a movable joint of the header and the vortex tube (that is, the expansion chamber) and a difference between the angle of incline of the chamber wall and the angle of incline of the header that a possibility is provided of setting-up and adjusting the cooler operation.

Figure 6:
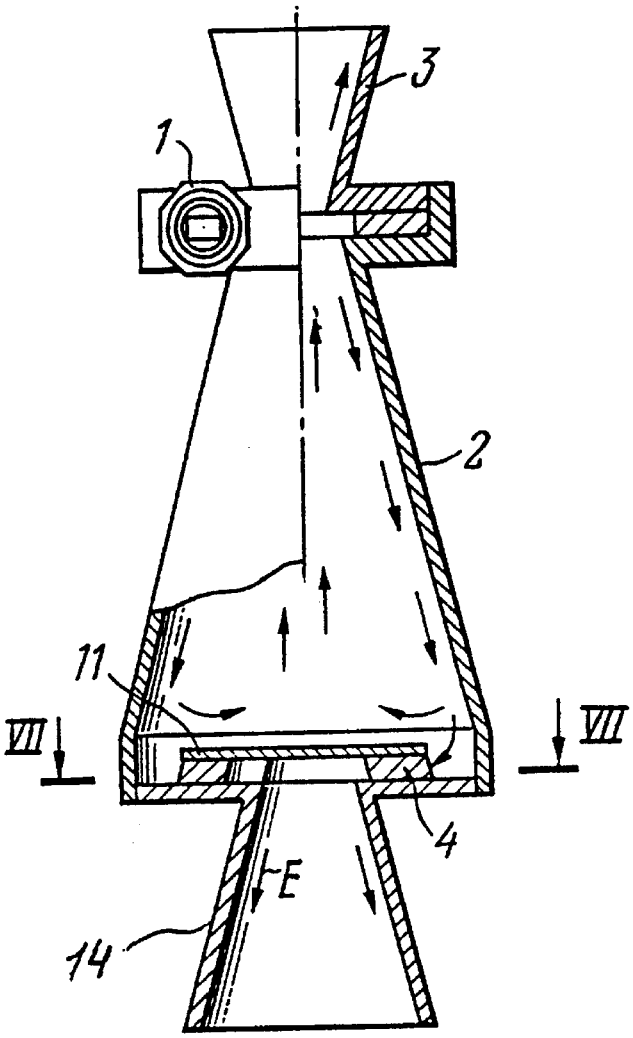
FIG. 6 is a sectional view of the gas cooler having a second scroll in the expansion chamber.
Figure 8:
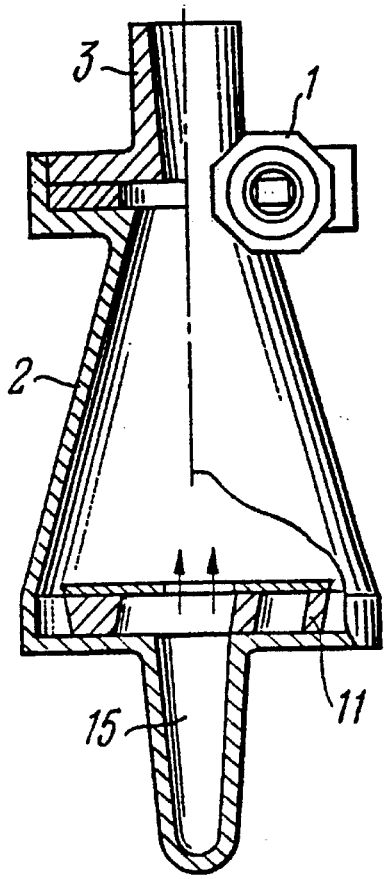
FIG. 8 is a sectional view of the gas cooler for carrying into effect the method of the invention, involving integration of the peripheral and axial stream parts.
Figure 7:
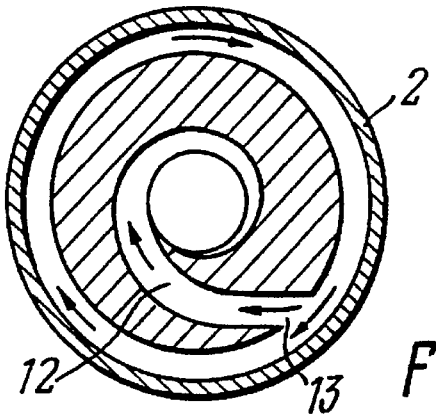
FIG. 7 is a section taken along the line VII—VII in FIG. 6.

According to a second embodiment of the device (FIGS. 6–8), a second scroll 1 is provided near the blank cover 4, the scroll having a spiral tapered duct 12 whose inlet 12 faces against the motion of the peripheral part of the gas stream, while the exit of the duct opens into the expansion chamber. The cooler may have a second exit nozzle 14 (FIG. 6) for the cooled gas to discharge, or else the entire amount of cooled gas is discharged via the common exit nozzle 3 (FIG. 8). The latter being the case, the blank cover 4 of the expansion chamber has a space 15 in the axial zone thereof, serving for a smooth integration of the peripheral stream part with its axial part.

Constructionally, the second scroll may be made integral with the blank cover of the expansion chamber rather than a self-contained member.

The method for gas cooling is carried into effect, and accordingly the operation of the gas cooler, according to the invention, as follows. The stream A of the gas to be cooled is pressure-admitted through the inlet nozzle into the scroll 1 and passes along the spiral tapered duct 6 towards the exit to the expansion chamber. While passing along the duct 6 the gas stream is swirled and accelerated to the sonic velocity. Upon passing the critical section of the duct the gas stream is further accelerated to the supersonic velocity and is discharged into the expansion chamber. Then the gas stream B which has passed through the scroll, performs the progressive rotary motion along the walls of the expansion chamber 2 towards the blank cover 4. The part C of the gas stream, after having been reflected from the blank cover 4, is withdrawn along the axial line, while performing rotary motion, to be discharged through the cold exit nozzle 3 (the axial part of the gas stream). The other (peripheral) part D of the gas stream either is withdrawn through the ports 7 in the wall of the expansion chamber and along the curved tubes 9, into the header 8 and further on to the consumer, (according to the first embodiment of the method and device of the invention), or is admitted to the second scroll 11, wherein the gas stream is reaccelerated and then re-expanded at the scroll exit. Then the gas stream which has passed the repeated cycle of acceleration and expansion either is discharged through the second cooled gas exit nozzle 14 (FIG. 6) or is joined with the axial stream and discharged together therewith through the exit nozzle 3.

When applying the present method and device which provide for discharge of the peripheral gas stream part at a minimum resistance offered thereto, both parts of the gas stream have a temperature at the cooler exit somewhat reduced compared with the inlet gas stream temperature, this being due to joining the pathways of the gas stream discharge with that of motion of the peripheral stream part in the expansion chamber, though the temperature of the peripheral stream part is somewhat higher than the temperature of axial part of the gas stream.

This adds substantially to the effectiveness of the gas cooling process and enables the present method and device for carrying its into effect to be used in most diverse fields of application.

I claim:

1. A method for gas cooling using a vortex tube comprising:

a) providing a vortex tube scroll and an expansion chamber;

b) swirling and accelerating a gas stream in said scroll;

c) discharging said gas stream from said scroll;

d) admitting said gas stream into said expansion chamber;

e) dividing said gas stream into an axial part and a peripheral part; and f) discharging from said expansion chamber said peripheral part along curvilinear pathways which are joined with a pathway of said gas stream.

2. A method for gas cooling comprising:

a) providing a vortex tube scroll and an expansion chamber;

b) swirling and accelerating a gas stream in said scroll;

c) discharging said gas stream from said scroll;

d) admitting said gas stream into said expansion chamber;

e) dividing said gas stream into an axial part and a peripheral part;

f) reswirling and reaccelerating said peripheral part; and g) discharging from said expansion chamber said peripheral part.

3. The method of claim 1, wherein after the step of reswirling and reaccelerating, said peripheral part is joined with said axial part.

4. A gas cooler for cooling a gas stream, wherein the gas stream is divided into a peripheral part and axial part, the cooler comprising:

a vortex tube including a scroll, a cooled gas exit nozzle on one side of said scroll, and an expansion chamber on a side opposite to said one side, (a) said scroll having a spiral tapered duct extending into said vortex tube;

(b) said expansion chamber having a blank cover at one end and an outlet for the peripheral part of the gas stream; and (c) said outlet including a plurality of ports in a wall of said expansion chamber, said ports having a curvilinear shape and being situated proximate to said blank cover.

5. The gas cooler of claim 4, further comprising:

a plurality of curved tubes connected to said ports, said curved tubes including axial lines being extensions of axial lines of said ports; and said tubes having exit ends integrated to form a header.

6. A gas cooler for cooling a gas stream, wherein the gas stream is divided into a peripheral part and axial part, the cooler comprising:

a vortex tube including a first scroll, a cooled gas exit nozzle on one side of said first scroll, and an expansion chamber on a side opposite to said one side, (a) said first scroll having a spiral tapered duct extending into said vortex tube;

(b) said expansion chamber having a blank cover at one end and an outlet for the peripheral part of the gas stream; and (c) a second scroll in the expansion chamber near the blank cover, said second scroll including an inlet and being oriented so that said inlet is positioned against motion of the peripheral part of the gas stream.

* * * * *